US005655509A

United States Patent [19]

Casas Salva

[11] Patent Number: 5,655,509

[45] Date of Patent: Aug. 12, 1997

[54] AIR GUNS OF THE RIFLE OR PISTOL TYPE

[75] Inventor: Francisco Casas Salva, Sant Boi De Llobregat, Spain

[73] Assignee: Industrias el Gamo, S.A., Barcelona, Spain

[21] Appl. No.: 587,302

[22] Filed: Jan. 16, 1996

[30] Foreign Application Priority Data

Jan. 18, 1995 [ES] Spain ..... 9500129

[51] Int. Cl.[6] ..... F41B 11/14

[52] U.S. Cl. ..... 124/66

[58] Field of Search ..... 124/65, 66, 67, 124/83

[56] References Cited

U.S. PATENT DOCUMENTS

| | | | |
|---|---|---|---|
| 2,633,839 | 4/1953 | Lawrence | 124/67 |
| 3,302,319 | 2/1967 | Rosselet . | |
| 3,472,218 | 10/1969 | La Mers . | |
| 4,367,723 | 1/1983 | Resuggan | 124/67 |
| 4,848,307 | 7/1989 | Tsao | 124/59 |
| 4,883,042 | 11/1989 | Wackrow | 124/67 |
| 5,205,271 | 4/1993 | Casas Salva | 124/66 |

FOREIGN PATENT DOCUMENTS

| | | | |
|---|---|---|---|
| 3306 | of 1908 | United Kingdom | 124/67 |
| 937658 | 9/1963 | United Kingdom . | |
| 945362 | 12/1963 | United Kingdom | 124/67 |
| 1219302 | 1/1971 | United Kingdom | 124/67 |
| 2 173 287 | 10/1986 | United Kingdom . | |

*Primary Examiner*—John A. Ricci
*Attorney, Agent, or Firm*—Graybeal Jackson Haley LLP

[57] ABSTRACT

Improvements in air guns of the rifle or pistol type. The air gun comprises a compression chamber-fork one-piece assembly (10), to be fastened to a buttstock of a gun, made of plastic material with a reinforcing web portion (14) connecting lower portions of both fork limbs (15) and with a plurality of anchoring appendages (34) projecting from the lower outer wall of the chamber to fit into matching slots of the buttstock. A one-piece body (16) made of plastic material integrates a stopper (25), spring guide (21), embellisher (33) and a support comprised of two parallel walls (17, 18) for a ratchet, trigger and intermediary elements of the gun.

16 Claims, 2 Drawing Sheets

FIG. 3
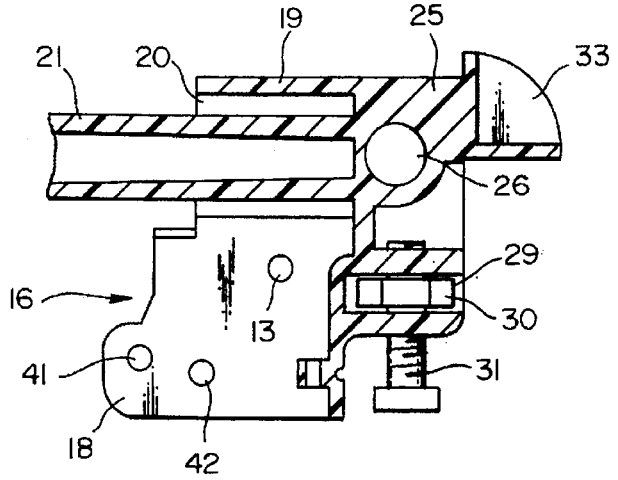
FIG. 4
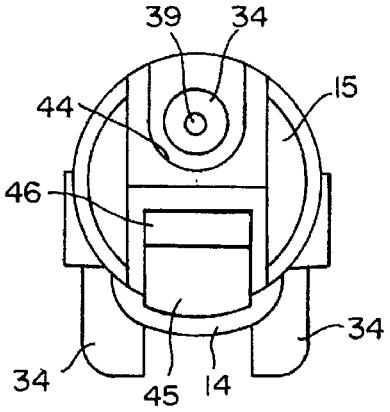
FIG. 5
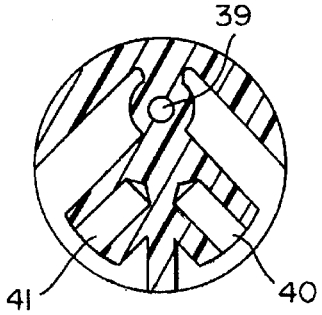
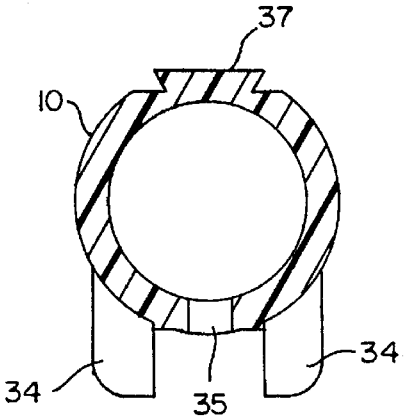
FIG. 6
FIG. 7
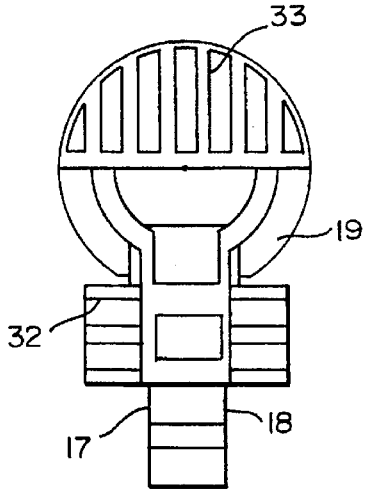

AIR GUNS OF THE RIFLE OR PISTOL TYPE

FIELD OF THE INVENTION

This invention relates to improvements in air guns of the rifle or pistol type comprising a compression chamber-fork one-piece assembly made of metal and obtained by cold extrusion forging to be fastened to the buttstock of the gun, said one-piece assembly innerly housing a piston associated to a spring and a guiding element for said spring, said chamber being closed at its rear end opposite the fork by a stopper to which an embellisher is generally attached, integrating besides a metallic support for mounting a ratchet provided to retain the piston in the compressed position, the trigger and the intermediary elements, said support being attached to said compression chamber-fork one-piece assembly, a barrel which is pin-jointed with said fork acting as a lever arm of a hinged leverage to compress said spring for loading the rifle or pistol

BACKGROUND OF THE INVENTION

Patent DE-A-1913239 describes an air gun of the mentioned type which is characterized in that the compression chamber cylinder and the gun barrel pin-jointing and tilting fork consist of a one-piece metallic element forged by cold forming (extrusion). Moreover and according to said document said fork and said cylinder are besides connected by a midwall of reduced thickness through which a short duct is formed for the passage of the compressed air.

Patent EP-A-467819 describes on the other hand the embodiment of said barrel pin-jointing fork in plastics material, and means for its attachment to the metallic body of the compression chamber cylinder, to the effect of lowering the manufacturing cost.

For the purpose of still further reducing the manufacturing cost for said guns, patent application FR-9314267 besides describes some improvements consisting in making said compression chamber piston out of plastics material by moulding to the shape of a tubular body associated to a high density, metallic element which in its turn acts as a guide for the compression spring, an additional, wear resistant metal plate having been provided and attached to a side of said tubular body for association with the ratchet.

SUMMARY OF THE INVENTION

The invention seeks to go one more step ahead in the use of plastics material to build an air gun, and for such a purpose it now intends to form a compression chamber-fork assembly in the shape of a one-piece body moulded in plastics material, but, unlike the provisions of said publication of prior art DE-A-1913239, by providing the assembly with means apt to allow its fastening to the buttstock of the gun and to assure an adequate stability of said fastening, thereby preventing any longitudinal shifting whatsoever. In effect, the execution of said one-piece assembly in metal allows a secure, firm and direct fastening to the buttstock body by means of screws screwed into holes provided in the cylinder wall of the compression chamber portion, but this is not feasible if said assembly is made out of plastics material, since the blow of the piston against the bottom of the chamber will bring about the deterioration of the fastening means in a very short time by reason of the stresses caused by the intervening longitudinal shifting loads. It also happens that if such a one-piece assembly is made of plastics material the fork, because of being flexible up to a given extent, will determine that if the gun is taken by the barrel a relative, transversal, bending motion can take place due to the slight deflection of the fork limbs.

To such an effect means have been provided to increase the safety of the fastening of said compression chamber-fork one-piece body to the buttstock body thereby taking up the longitudinal shifting loads, and a reinforcing web portion has also been provided to mutually connect a portion of each of the fork limbs by their lower part, all this as detailed in the general concept of the present invention which also contemplates the fact of building a one-piece body integrating said metallic support for mounting the ratchet, trigger and other intermediary elements, the stopper for closing the compression chamber at its rear end, the embellisher and the spring guide, said one-piece body being attached to the end of the compression chamber cylinder by means of a simple transversal pin. This also avoids the attachment of said metallic support to the compression chamber body, and the mounting on the former of said elements (ratchet, pawl, trigger, etc.) in many cases with the aid of the support provided by a part of the gun body (lateral plates, for example).

Other advantageous aspects of the invention are described in the subclaims.

From all this derive cost savings in the process of manufacture of the air guns of the rifle or pistol type because of the materials employed and of the considerable reduction and simplification of the assembly of the above-mentioned elements and the association of the subassemblies.

Other characteristics and the advantages of the invention will become more apparent when reading the following description of the latter given with the aid of the accompanying sheets of drawings of an embodiment to be considered as a merely illustrative and nonlimiting example.

BRIEF DESCRIPTION OF THE DRAWINGS

In said drawings:

FIG. 3 is a sectioned elevation of said one-piece body whose spring guiding portion has been partially eliminated, showing the means for fastening it to the buttstock and to the compression chamber-fork assembly;

FIG. 4 is a front view of the compression chamber-fork one-piece assembly as seen in the direction of arrow IV in FIG. 2;

FIG. 5 is a cross-section of the compression chamber-fork one-piece assembly along section line V—V in FIG. 2;

FIG. 6 is another cross-section of the compression chamber-fork one-piece assembly along section line VI—VI in FIG. 2;

And lastly FIG. 7 is a back view of the one-piece body attached to the rear end part of the compression chamber-fork assembly as seen in the direction of arrow VII in FIG. 2.

DETAILED DESCRIPTION

Figure 1:
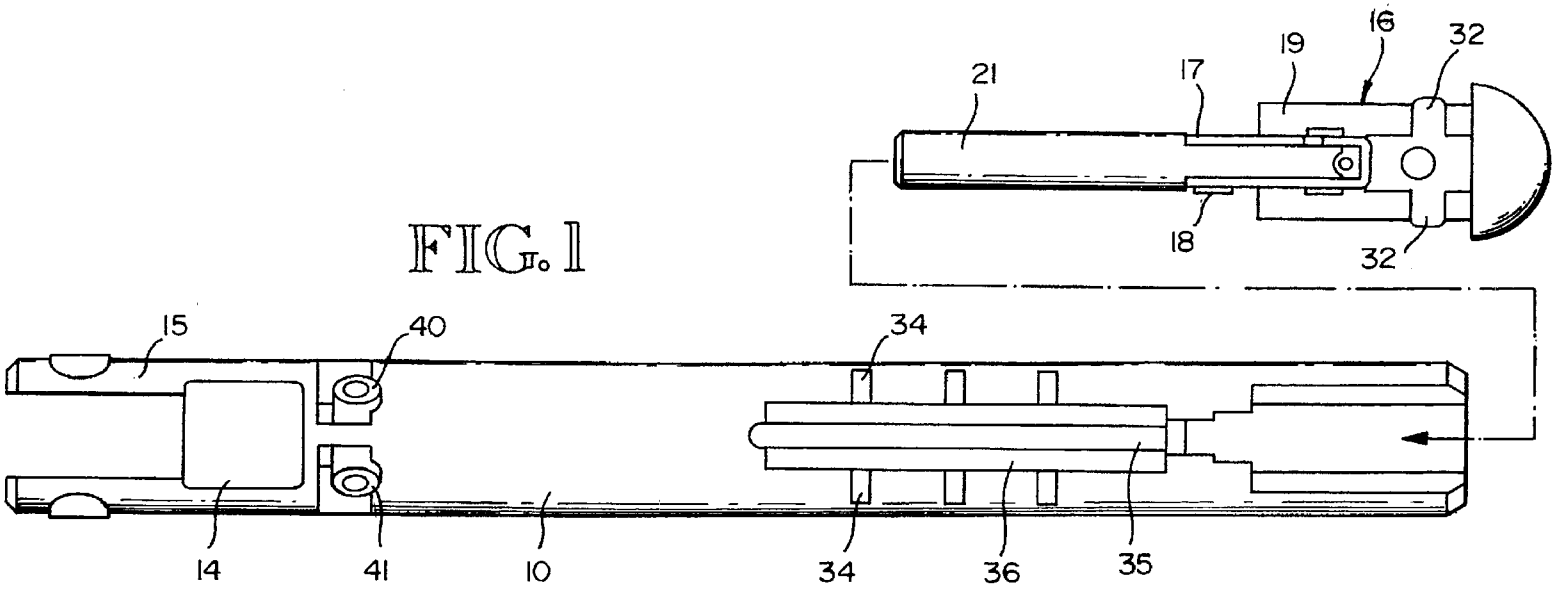
FIG. 1 is a bottom plan-view (the part resting on the buttstock) of the compression chamber-fork one-piece assembly made of plastics material and obtained by moulding in one only operation, with a one-piece body also moulded in plastics material and including the stopper for closing the rear end of said chamber, the guide for the spring and the support for mounting the ratchet, the trigger and other intermediary elements, as well as the embellisher, said one-piece body having been as well separately illustrated in bottom plan-view, a dash-and-dot line and an arrow indicating the way it is to be arranged inside said first one-piece assembly as precisely shown in FIG. 2.

It can be appreciated in these Figures that the fork serving as a support for the hinged connection of the barrel (not shown) which acts as a lever arm of a leverage for compressing a spring 12, and the compression chamber housing said spring and associated piston 11, 11*a*, form a one-piece assembly 10 made of plastics material in one only moulding operation, with the particularity that said compression chamber-fork one-piece assembly 10 includes a web portion 14 connecting lower portions of both fork limbs 15 in the vicinity of the fork bottom thereby strengthening them and preventing their separation, said one-piece assembly 10 also including a plurality of anchoring appendages 34 projecting from the lower outer wall of said chamber and provided to fit by way of bearing members into matching slots provided in the buttstock body thereby preventing any longitudinal shifting whatsoever and the deterioration of the attachment of assembly 10 to the buttstock as a consequence of firing the gun (blows of the piston against the bottom of the compression chamber). Furthermore, the stopper usually closing the rear end part of the compression chamber, the spring guiding element, the embellisher and the support for the ratchet, trigger and intermediary elements (pawl, etc.) are made of plastics material by moulding and as a single one-piece body 16 whose characteristics can be appreciated particularly in FIGS. 1 (bottom plan-view), 2 (side elevation) and 3 (sectional view).

Figure 2:
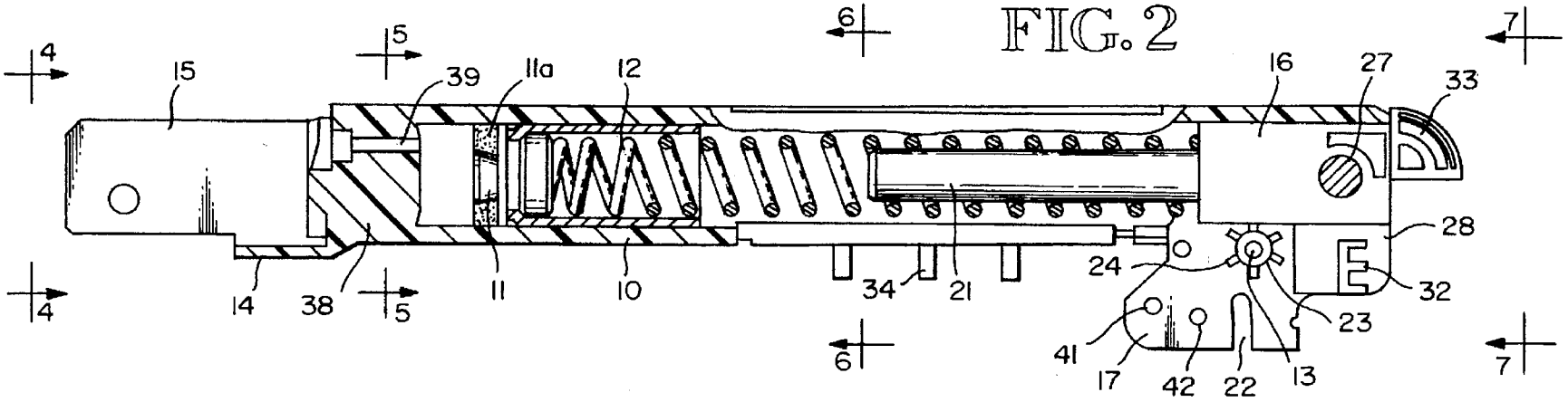
FIG. 2 is a partially sectioned elevation of the compression chamber-fork one-piece assembly of FIG. 1 with said one-piece body introduced in the rear end part of said chamber and attached to it by a transversal pin. Inside said chamber can also be appreciated the piston and the conveniently guided spring.

According to the invention, the part of the one-piece body 16 serving as a support for the ratchet, trigger and intermediary elements comprises as shown in FIG. 1 two parallel walls 17, 18 ending at the top in a cylindrical shell 19 which forms a portion of the lateral wall of the body of said stopper and delimits internally an annular blind cavity 20 (see FIG. 3) from whose bottom starts a tubular element 21 provided to serve as a guide for the spring as shown in FIG. 2.

In said parallel walls 17, 18 there are several holes 13, 41, 42 which are directly opposite each other two by two to thus allow to arrange through them corresponding transversal pins for mounting the ratchet, trigger and other intermediary elements, such as for example the pawl, a slightly arcuate, oblong notch 22 having been provided in one of said walls 17 for the passage of a moving auxiliary element, said holes 13 provided for fastening the pin that will support in a hinged connection the ratchet holder comprising a thickened rim 23 surrounding the corresponding hole and extending outwards in radial ribs 24 to the effect of reinforcing said part, which will be the most overstressed one when the ratchet exerts its spring retaining action. Such an arrangement facilitates to a great extent the assembly job, as well as the automatization of the process, since those elements consisting in the ratchet, pawl, trigger and other auxiliary elements can be now very easily assembled in a separate station thanks to the characteristics and dimensions of the piece which facilitate its fastening and/or gripping, and once having incorporated all this elements the fully equipped piece is then attached to the compression chamber-fork one-piece assembly 10 by means of inserting the stopper portion 19 into the rear end part of the cylinder of said chamber as shown in FIG. 2.

As it can be seen in FIG. 3, said annular cavity 20 extends backwards in a solid portion 25 ending in a projecting part 33 serving as an embellisher (a possible ending being shown only by way of an illustrative example in the back view of FIG. 7), said solid portion having a transversal hole 26 for the fastening to the rear end part of the compression chamber by means of a transversal pin 27 (see FIG. 2) arranged through two opposite holes of said chamber which are coaligned with said hole 26, said solid portion extending downwards in an extension 28 which connects with said two supporting parallel walls 17, 18 thereby closing their rear end part. Said extension 28 includes besides a pocket 29 to house a nut 30 into which a bolt 31 is to be screwed for fastening said one-piece body to the buttstock.

As it can be seen in FIGS. 2 and 7, on both sides of said extension 28 of said one-piece body 16 there are protruding ribs 32 provided to fit into matching recesses of the gun buttstock.

Therefore, by means of the appendages 34 and of these protruding ribs 32 inserted into matching slots and recesses of the buttstock an immobility is guaranteed in spite of the longitudinal shifting loads intervening as a consequence of the blow of the piston against the bottom of the chamber, and a stable attachment of the one-piece assembly 10 to the buttstock of the rifle or pistol in question is in short guaranteed.

As shown in FIG. 1, the appendages 34 provided by way of anchoring and bearing members of the lower wall of the compression chamber-fork one-piece body 10 are situated at both sides of a slit 35 for the passage of the spring loading lever, said slit being flanked at both sides by flat surfaces or slides 36 provided to allow a holder of said lever to slide on them.

On the top part of the compression chamber-fork one-piece body 10 an elongated, dovetail-shaped stretch 37 has been also provided which is obtained when moulding said one-piece body 10 and is intended to serve as a support for a sight.

In the sectioned FIG. 2 it can be besides appreciated that, unlike the solution described in the German patent DE-A-1913239, between the bottom of fork 15 and the compression chamber there is a wide midwall 38 with a hole 39 piercing it right through for the passage of the compressed air, said midwall providing enough material to form two inclined and converging holes 40, 41 sticking out in the zone of the lateral wall of the compression chamber-fork one-piece assembly 10 for its fastening to the buttstock by means of screws. Said one-piece assembly 10 and said one-piece body 16 will once joined together as shown in FIG. 2 be in this way attached to the buttstock by the front part (holes 40, 41) and by means of bolt 31 screwed into nut 30 at the rear part.

In FIG. 4 it can be appreciated that the bottom of the fork has been shaped with a configuration which corresponds to that of patent EP-A-0467819 of the same inventor, i.e. includes an annular recess 43 for a seal surrounding hole 39, a half-round seat 44 and a cavity 45 for the locking catch, said cavity upperly ending in an inclined plane 46.

I claim:

1. In a rifle or pistol air gun having a compression chamber-fork one-piece assembly to be fastened to a buttstock body of said gun, said one-piece assembly including a pair of forks, an improvement comprising: said compression chamber-fork one-piece assembly being made of synthetic polymeric material and having a reinforcing member connecting lower portions of both of said forks;

a plurality of anchoring appendages projecting from an outer wall of said compression chamber-fork assembly adapted to fit into matching slots provided in said buttstock body; and a one piece body made of synthetic polymeric material having a stopper, a spring guide, and a support for a ratchet and a trigger.

2. The improvement, as claimed in claim 1, wherein said support of said one-piece body includes two parallel walls ending in a cylindrical shell which forms a portion of a lateral wall of said stopper.

3. The improvement as claimed in claim 2, wherein:

said parallel walls have holes therethrough for attachment of transverse pins for mounting said ratchet and said trigger.

4. The improvements, as claimed in claim 2, wherein:

said two parallel walls of said one piece body connect to a solid portion having a transverse hole for fastening of said solid portion to said compression chamber-fork one piece assembly by means of a transverse pin which passes through said chamber; and said solid portion including a pocket to house a nut into which a bolt is attached for fastening said one-piece body to said buttstock body.

5. The improvement as claimed in claim 1, wherein on said one-piece body there are protruding ribs matable with matching recesses in said buttstock body.

6. The improvement as claimed in claim 1, wherein said anchoring appendages project from a lower outer wall of said compression chamber-fork one-piece assembly and are situated on both sides of a slit for the passage of a spring loading lever.

7. The improvement as claimed in claim 1 further comprising an elongate slot on said compression chamber-fork one-piece assembly to support a sight.

8. The improvement as claimed in claim 1, wherein angled openings in said compression chamber-fork one-piece assembly are adapted for fastening to said buttstock body.

9. In a rifle or pistol air gun having a compression chamber-fork one-piece assembly to be fastened to a buttstock body of said gun, said one-piece assembly including a pair of forks, an improvement comprising:

said compression chamber-fork one-piece assembly being made of synthetic polymeric material and having a reinforcing member connecting lower portions of both of said forks; and a plurality of anchoring appendages projecting from an outer wall of said compression chamber-fork assembly adapted to fit into matching slots provided in said buttstock body.

10. The improvement as claimed in claim 9, further comprising a one piece body made of synthetic polymeric material having a stopper, a spring guide, and a support for a ratchet and a trigger wherein said support of said one-piece body includes two parallel walls ending in a cylindrical shell which forms a portion of a lateral wall of said stopper.

11. The improvement as claimed in claim 10, wherein:

said parallel walls have holes therethrough for attachment of transverse pins for mounting said ratchet and said trigger.

12. The improvement as claimed in claim 10, wherein:

said two parallel walls of said one piece body connect to a solid portion having a transverse hole for fastening of said solid portion to said compression chamber-fork one piece assembly by means of a transverse pin which passes through said chamber; and said solid portion including a pocket to house a nut into which a bolt is attached for fastening said one-piece body to said buttstock body.

13. The improvement as claimed in claim 10, wherein on said one-piece body there are protruding ribs matable with matching recesses in said buttstock body.

14. The improvement as claimed in claim 9, wherein said anchoring appendages project from a lower outer wall of said compression chamber-fork one-piece assembly and are situated on both sides of a slit for the passage of a spring loading lever.

15. The improvement as claimed in claim 9 further comprising an elongate slot on said compression chamber-fork one-piece assembly to support a sight.

16. The improvement as claimed in claim 9, wherein two angled openings in said compression chamber-fork one-piece assembly are adapted for fastening to said buttstock body.

* * * * *